United States Patent [19]

Long et al.

[11] 3,986,718

[45] Oct. 19, 1976

[54] GOLF GAME

[75] Inventors: Donald W. Long, Wildwood Crest, N.J.; Stephen Horniak, Ivyland, Pa.

[73] Assignee: Donald W. Long, Wildwood Crest, N.J.

[22] Filed: June 25, 1975

[21] Appl. No.: 590,019

[52] U.S. Cl. ..... 273/176 FA; 273/179 R; 273/180; 273/125 A

[51] Int. Cl.[2] ..... A63B 69/36

[58] Field of Search ..... 273/176 FA, 185 R, 182 R, 273/125 R, 125 A, 179, 180

[56] References Cited

UNITED STATES PATENTS

| | | | |
|---|---|---|---|
| 3,011,791 | 12/1961 | Page | 273/176 FA X |
| 3,588,117 | 6/1971 | Hertenstein | 273/185 R |
| 3,645,536 | 2/1972 | Tierney | 273/176 FA X |
| 3,756,606 | 9/1973 | Land | 273/182 R |
| 3,784,207 | 1/1974 | Gentiluomo | 273/176 FA |
| 3,791,653 | 2/1974 | Yamada | 273/185 R |

*Primary Examiner*—George J. Marlo
*Attorney, Agent, or Firm*—Edelson and Udell

[57] ABSTRACT

A coin operated golf type game in which the player strikes a golf ball with a golf club and drives the ball up a ramp to a target area having scoring holes through which the ball may drop. The ball returns along a track system to a ball collection point and during the course of its travel actuates the various scoring devices which illuminate the scoring board, and sounds bells or horns in accordance with which scoring hole the ball has entered. Both positive and negative scoring increments are used. When a predetermined number of balls have been played, the game scoring is automatically terminated and an indicator lights showing the scoring proficiency of the player. If a sufficiently high score is achieved, the player is awarded a free game.

13 Claims, 2 Drawing Figures

GOLF GAME

This invention relates generally to coin operated games, and more particularly relates to a coin operated golf type game in which the player strikes a golf ball with a golf club and drives the ball up a ramp to a target area having scoring holes through which the ball may drop. The ball returns along a track system to a ball collection point and during the course of its travel actuates the various scoring devices which illuminate the scoring board, and sounds bells or horns in accordance with the nature of the score which has been made. When a predetermined number of balls have been played, the game is automatically terminated and an indicator lights showing the scoring proficiency of the player. If a sufficiently high score is achieved, the player is awarded a free game.

A principal object of the invention is to provide a novel coin operated golf game in which a player hits golf balls toward a target area for the purpose of accumulating a sufficiently high score to win a free game, the game apparatus utilizing electrical switches and counting devices actuated by the golf ball to cause registration of the score on a score board.

Another object of the invention is to provide a novel coin operated golf game as aforesaid in which the apparatus is so arranged that golf balls which enter certain holes in the target area cause the player's score to increase, while golf balls which enter other holes in the target area will cause the player's score to decrease.

A further object of the invention as aforesaid is to provide a novel coin operated golf game which utilizes a ball counting device to determine when a predetermined number of balls have been utilized in the course of the game, and to lock out the scoring mechanism when the predetermined number of balls has been played so that additional golf balls played thereafter cannot alter the score.

Figure 1:
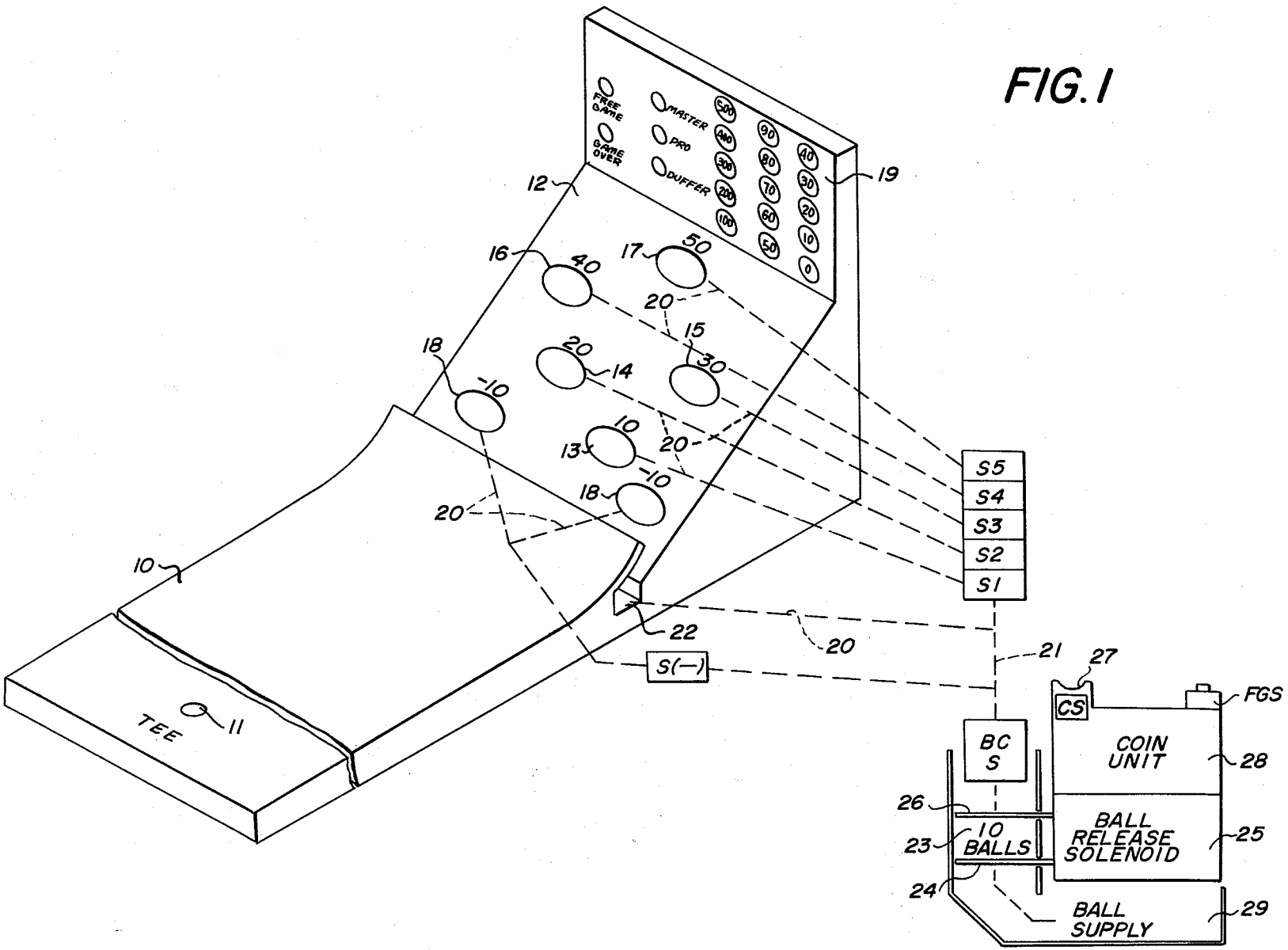
Figure 2:
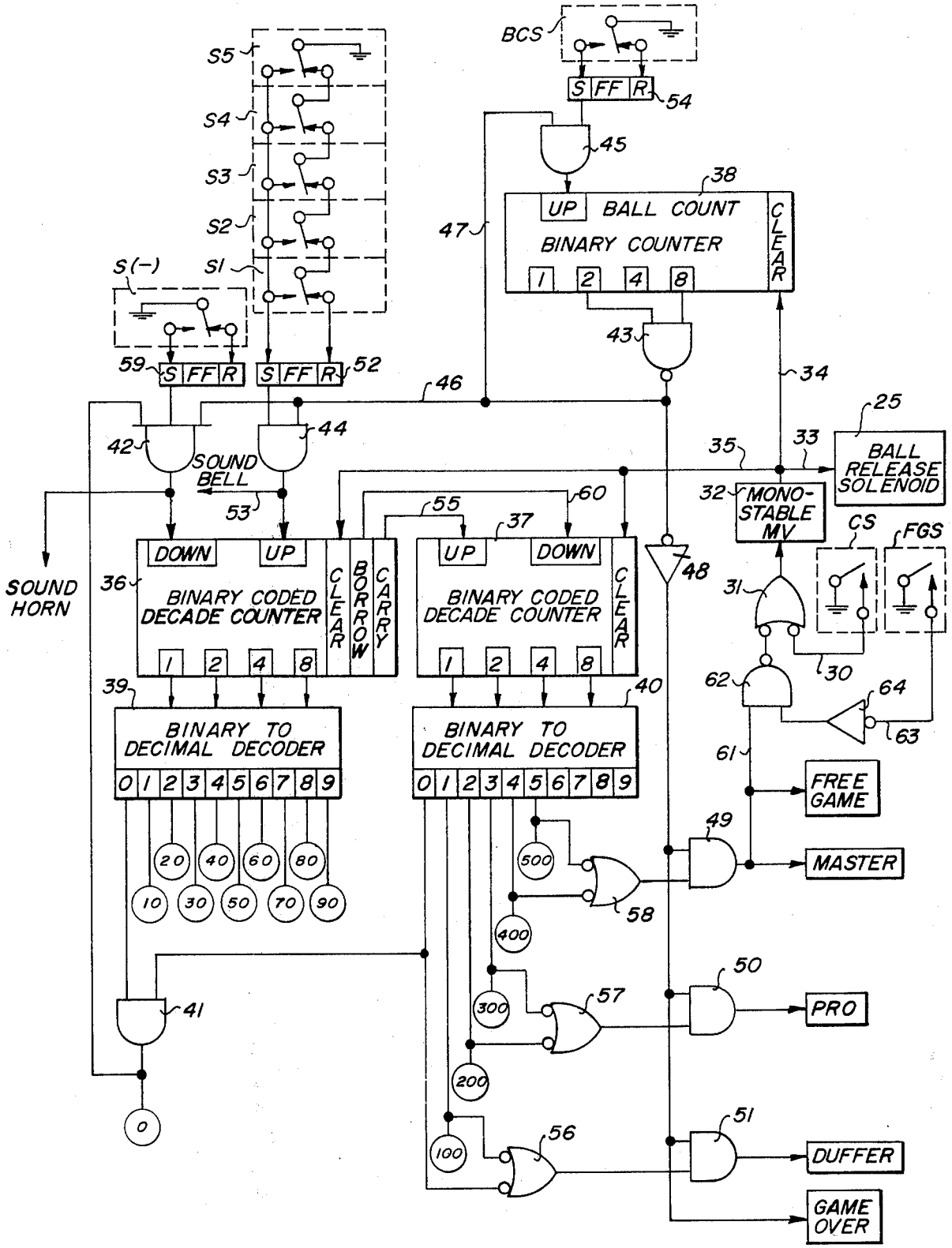

The foregoing and other objects of the invention will appear more fully hereinafter from a reading of the following specification in conjunction with an examination of the appended drawings, wherein:

FIG. 1 is an isometric and partial diagrammatic showing of the physical apparatus according to the invention; and FIG. 2 is a functional block diagram of the circuitry which operates the apparatus.

In the several figures, like elements are denoted by like reference characters.

Referring now to the drawings, FIG. 1 shows diagrammatically the physical apparatus for playing the game according to the invention. The apparatus includes generally a driving ramp 10 having a tee 11 from which the golf balls are driven toward the target area 12 which contains a number of scoring holes, 13 through 17, which respectively cause an increase in score of the player by increments of ten, twenty, thirty, forty and fifty points, and a further pair of scoring holes 18 each of which cause a decrease in the score of the player in increments of ten points. Above the target area 12 is a display board 19 provided with lights which display the player's score from zero to five hundred points in increments of ten points. Additionally, there are lights which indicate that the game is over, that a free game has been won, and whether the player has scored as a Duffer, Pro or Master.

Below each of the scoring holes 13 through 18 is a ball guide track 20 which leads from the scoring hole over to a common ball guide track 21 via a series of switches S1 through S5 and S(−). A ball which has dropped through the scoring hole 13 must, as shown, actuate switch S1 as it rolls from the scoring hole to the common ball guide track 21. Similarly, a ball which has fallen through scoring hole 14 must actuate the switches S2 and S1 on its path toward the common ball guide track 21. In the same fashion, balls which have passed through scoring holes 15, 16 and 17 will respectively actuate the three switches S1 – S2 – S3, S1 through S4, and S1 through S5. On the other hand, balls which have dropped through the scoring holes 18 will only actuate the switch S(−), whereas balls which have fallen through none of the scoring holes but which are received by the collection track 22 are routed directly over to the common ball guide track 21 without actuating any of the switches S1 through S5 or S(−).

As will be subsequently seen, whenever one of the switches S1 through S5 is actuated, a positive incremental score of ten points is registered on the score board, so that it will be understood that a ball which drops through scoring hole 17, corresponding to a score of 50, will sequentially actuate all of the switches S5 down through S1 and will therefore cause five 10 point scores to be sequentially added to the total on the display board 19. In similar fashion, a ball which has dropped through scoring hole 14 will actuate two switches, S2 and S1, and will cause two 10 point increments to be added to the player's score on the display board 19. Each of the scoring holes 18 corresponds to a minus ten score which is brought about by actuation of the S(−) switch, all in the manner to be subsequently described.

Each ball which arrives at the common ball guide track 21 continues to roll downward toward a collection point and actuates a ball count switch BCS. The ball count switch actuates circuitry which keeps a running count of the number of balls which have been played, and when a predetermined number, such as ten balls, has been played, the scoring mechanism is disabled so that no further scoring can take place irrespective of how many additional balls might be played. This feature is of significance for example in amusement centers where the high score recorded during some given time interval, such as a month, will be awarded a prize. In such a circumstance, players have been known to provide additional playing devices of their own in order to increase their scores to win such a prize. In a game such as is presently being described, it would of course be a simple matter for a player to bring two or three additional balls of his own and play them in order to run up a score. This possibility is avoided through the circuitry associated with the ball count switch BCS which locks out the scoring mechanism after the predetermined number of balls have been played irrespective of where those balls have come from.

After each ball has passed the ball count switch BCS it continues down the common guide track 21 to a ball collection region 23 where the continued flow of the balls is stopped by a gate 24 which is connected to and actuatable by a ball release solenoid 25. Also connected to and actuatable by the ball release solenoid 25 is a second gate 26. When the ball release solenoid 25 is in its deenergized state, the gate 24 obstructs the path of the returning golf balls so that the golf balls pile up there-behind in the collection region 23, while the gate 26 is held in an open or unobstructing position with respect to the movement of the golf balls. When the proper coin is inserted through the coin slot 27 of coin unit 28, the coin trips coin switch CS which clears the score board 19 to zero and actuates the ball release solenoid 25.

When the ball release solenoid 25 is actuated, gate 26 is moved across the common ball guide track 21 at a point such that the predetermined number of balls is contained within the ball collection region 23, and the gate 24 is then retracted so that the predetermined number of balls can descend into the ball supply bin 29 where the balls are accessible for use by the player. When a sufficient time has elapsed for all of the balls to have descended into the ball supply 29, the ball release solenoid 25 is automatically deenergized, thereby returning the gates 24 and 26 to their obstructing and non-obstructing positions. The free game switch FGS is rendered effective if a player has obtained a score which qualifies him as a Master, and when this occurs, depression of the FGS switch has the same effect as the deposit of a coin into the coin slot 27.

Understanding now generally how the apparatus according to the invention operates, attention should be directed to the showing of FIG. 2 which illustrates in schematic form the circuitry which controls the operation of the apparatus of FIG. 1. Assume that a player has just deposited a coin into the coin unit 28 so that the coin switch CS has been actuated. This causes a "low" signal on line 30 which is transmitted to one input of inverter "or" gate 31 so that the signal emerges as a "high" which triggers monostable multivibrator 32. The output signal from monostable multivibrator 32 is transmitted via line 33 to ball release solenoid 25 which it actuates to cause the balls in the ball collection region 23 to be deposited into the ball supply 29 in the manner previously described.

Additionally, the output signal from monostable multivibrator 32 is transmitted via lines 34 and 35 to the "clear" inputs of binary counters 36, 37 and 38 to clear their counts down to zero, thereby extinguishing all of the indicator lights on the display board 19 and lighting the zero score indicator light. The zero indicator light on the display board is illuminated because each of the binary-to-decimal decoders 39 and 40 is in its zero output condition so that a pair of low signals are presented to and gate 41 which are gated through as a low to illuminate the zero indicator and also to recirculate the low signal back as one of the inputs on and gate 42.

Since ball-count binary counter 38 is also cleared to its zero count condition, the two and eight count outputs of counter 38 are lows signifying a count of "not ten". These low signal inputs to inverter and gate 43 appear at the output of the gate as a high signal which is routed as one input to each of and gates 42, 44 and 45 via signal lines 46 and 47, and through inverter amplifier 48 as a low input signal to each of and gates 49, 50 and 51. The binary counters 36, 37 and 38, and the "Game Over", "Duffer", "Pro" and "Master" indicators all require high signals as actuating inputs, and since and gates 42, 44, 45, 49, 50 and 51 only produce highs at their outputs when all of the input signals to the gates are highs, the following conditions have been established.

First, as long as ball-count binary counter 38 does not register that ten balls have been played, the output from binary counter 38 transmitted through gate 43 and amplifier 48 to gates 49, 50 and 51 will be a low level signal, thereby preventing actuation of the indicators designating Game Over, Duffer, Pro, Master and Free Game, when appropriate. Accordingly, these indicators will only be actuated after ten balls have been played. Additionally, the low signal output from ball-count binary counter 38 when a count of "ten" is not present is transmitted through inverter gate 43 as a gate enabling high signal on each of and gates 42, 44 and 45. Consequently, these gates are only enabled to transmit signals as long as the counter 38 indicates that less than ten balls have been played, and once ten balls have been played, and the count in counter 38 becomes ten, the two and the eight outputs from the counter are gated through inverter 43 as a low signal which thereafter inhibits and gates 42, 44 and 45 and prevents any further inputs to the decade counters 36 and 37 and to the ball-counter 38.

With the decade counters 36 and 37 incapable of receiving further input signals, the score which is at that time registered on the display board 19 cannot be further changed irrespective of how many additional balls may be played from some auxiliary source of golf balls. Thus, the score is locked. At that time, the ten count signal from the ball-count counter 38 also passes through inverter amplifier 48 and is presented as a high signal at the input to each of gates 49, 50 and 51 and therefore enables each of these gates so that a high signal which necessarily appears at the other input of one of those gates will generate an output signal which will actuate the appropriate indicator such as Duffer, Pro or Master and Free Game. Of course, this high signal through the inverter amplifier 48 also of itself actuates the Game Over indicator.

Assume now that, as previously described, a coin had been deposited into the coin unit so that the balls had been released into the ball supply 29 and the counters 36, 37 and 38 are all cleared to zero, as is the display board, the count-up gate 44 and ball count gate 45 have been enabled by the not ten signal from the output of the ball-count counter 38, and the count-down gate 42 is inhibited because of the low signal present thereon from the output of and gate 41 due to the zero score condition shown on the display board 19. The inhibit on count-down gate 42 is necessary because no negative score is recorded on the display board, and minus count scores initially recorded would interfere with subsequent positive counts into the decade counter 36. As will be seen, as soon as a positive score is recorded, the inhibiting signal on count-down gate 42 is replaced by an enabling signal so that the gate is rendered functional and down counts can be recorded, at least until a condition might occur wherein the game score count were reduced to zero. If such condition should occur, the inhibit signal would again be placed on count-down gate 42.

Assume now that the player has teed up and struck a golf ball which has landed in the target area 12 and finds its way into scoring hole 15 corresponding to a score of thirty points. The ball after dropping through the scoring hole rides along track 20 towards the common ball guide track 21 and actuates in sequence switches S3, S2 and S1. Actuation of switch S3 places a low into the set input of flip flop 52 which generates a high signal at its output which latter is connected as one input to and gate 44. Since gate 44 is enabled by the high signal on line 46 from ball count counter 38, the high signal passes through gate 44 to the up-count input of decade counter 36 producing a count of one at the output of the counter 36. The one count output from counter 36 is transmitted as an input to the decimal decoder 39 which registers a one count at its output and actuates the display board score indicator representing ten points.

At the same time as the signal from gate 44 was presented to the up-count input of decade counter 36, it also was routed via line 53 to an audible signal actuator such as a bell. Thus, each time the ten point score increment occurs a bell is sounded. As soon as the golf ball passes switch S3, the pole of the switch deactuates generating a low signal into the restore input of flip flop 52 which causes the flip flop set output to go low, thereby terminating the signal into gate 44 and conditioning the counter 36 to receive its next signal.

After the golf ball has passed out of engagement with switch S3 it continues rolling along the trackway and engages switch S2 causing the pole of the switch to transfer and generate an input signal to the set input of flip flop 52 which again generates a high signal at its output, which high passes through and gate 44 to the count-up input of counter 36 and steps the count output to a count of two. The count of two into the decimal decoder 39 causes its output count to shift from one count to the two count, thereby extinguishing the ten point indicator on the display board 19 and actuating the twenty point indicator. Again of course the score bell is sounded via line 53. As the golf ball passes out of engagement with switch S2, the pole of the switch returns and again places an input into the restore input of flip flop 52 causing the flip flop set output to go once again to a low signal state. The ball continues its passage and engages switch S1 and produces an additional count in the manner already described so that the score on the display board will read 30.

The golf ball has now passed out of contact with the score switches and continues down the common ball guide track 21 where it engages the ball-count switch BCS as it continues its passage down into the ball collection region 23 where its motion is terminated by the gate 24. Actuation of the ball-count switch BCS transfers the switch pole to the contact connected to the set input of flip flop 54, thereby causing the flip flop set output to go high and pass through enabled and gate 45 to the up-count input of ball-count counter 38 so that an output count of one is registered. Since the count is not ten, the signal conditions on the two and eight count outputs of the counter 38 are not both high and the output signal conditions from the counter 38 remain the same.

Assume now that several balls more are played so that the count registered on the display board just reaches a score of one hundred. When this happens, the decade counter 36 has counted back to zero and a "carry" signal is generated from its carry output and transmitted via line 55 to the count-up input of decade counter 37 so that counter 37 steps to its one state, transmits this to the decimal decoder 40 which thereupon shifts from its zero to its one state and actuates the one hundred score indicator, simultaneously of course passing through inverter or gate 56 as a high signal to and gate 51. This signal presented to and gate 51 cannot cause any further action since the other signal on and gate 51 is a low. This same action will occur each time the count reaches some multiple of 100, so that a carry signal is generated to step decade counter 37 and increase the hundreds count through decimal decoder 40. The inverter or gates 57 and 58 function in the same manner as that already described for inverter or gate 56.

When the score count changed from ninety to one hundred, decimal decoder 39 stepped back to a zero count so that a low signal was again presented to and gate 41. However, the low signal which was on and gate 41 from the zero count of decimal decoder 40 has now become a high signal because the decoder 40 has shifted its count from its zero to its one state. Accordingly, the high enabling signal still appears on down-count "and"to gate 42 and this gate is not disabled. This same condition will of course exist every time a one hundred point score change occurs, so that it will be understood that the only time that down-count gate 42 is inhibited is when both decimal decoders 39 and 40 are simultaneously at their zero count states. Accordingly, negative count below a zero score is precluded.

If a ball is hit which drops through either of the scoring holes 18 so that it will pass over the ball guide tracks to actuate the S(−) switch, a ten point score decrease occurs in the following manner. Actuation of the S(−) switch causes its pole to transfer and pulse the set input of flip flop 59 so that a high level signal is produced at the set output of flip flop 59 which passes through enabled and gate 42 to the down-count input of counter 36 causing the latter to decrease its count by one from the count previously stored therein. Assuming that the count shown on the display board 19 is not zero and is not one hundred through five hundred, but is in fact some number between the hundreds, the down-count into the counter 36 causes a corresponding down-count in decimal decoder 39 to reduce the score as shown therein by ten points.

However, should the count on the display board be an integral hundreds count, say two hundred, then the count in the decade counter 36 will be zero while the count in decade counter 37 will be a two count. The down-count into decade counter 36 causes this counter to shift its count from zero to nine thus actuating the 90 indicator, and to simultaneously generate a "borrow" signal at its borrow output which is routed via line 60 to the down-count input of decade counter 37. This down-count into counter 37 causes it to step its count backwards from two to one and to thereby cause the decimal decoder 40 to shift its output count from two to one and deactuate the two hundred count indicator while actuating the one hundred count indicator. The down-count signal from and gate 42 is also utilized to actuate a horn which indicates that a negative score has occurred, the horn sound being distinctively different from the bell sound denoting a positive score increment. Any suitable mechanism may be used.

Assume now that the tenth ball has been played, the score has been registered, and the ball-count switch BCS has caused the ball-count counter 38 to register the tenth ball. If the final score achieved by the player has been less than two hundred, a high signal will be present on and gate 51 from inverter or gate 56, and when the output of inverter amplifier 48 goes high due to the registration of the tenth ball count, the Duffer indicator will be actuated in addition to the Game Over indicator. If a score is achieved of two hundred but less than four hundred, the Pro indicator will be actuated via gates 50 and 57, and of course also the Game Over indicator. If a score of four hundred or more has been achieved, in addition to the Game Over indicator being acuated, the Master and Free Game indicators will be actuated via gates 49 and 58.

The high level signal which actuates the Free Game indicator also passes via signal line 61 as an enabling signal to inverter and gate 62. With gate 62 enabled, should the player now actuate the free game switch FGS, transfer of the switch pole causes a low signal to be transmitted via lines 63 through inverter amplifier 64 as a high signal to the other input of inverter and gate 62. The coincidence of high signals at the inputs to gate 62 causes a low signal to be transmitted to inverter or gate 31 from which it emerges as a high signal to trigger monostable multivibrator 32 and set in motion the initializing sequence in just the same manner as though a coin had been inserted into the coin slot 27 of the coin unit 28. It will be observed, that actuation of the free game switch FGS has no effect whatever in the absence of the conditioning signal on line 61 which only arises when a free game has actually been won by reason of the achieved score.

The components shown in FIG. 2 are all standard logic components connected in their normal and usual manners. The switches are all spring-loaded single-pole double-throw switches, and may be those of any suitable manufacturer. The monostable multivibrator 32 could typically be a Motorola type MC 1455 with a period of approximately two seconds. The up/down decade counters 36 and 37 could typically be Motorola type SN 74193, while the decimal decoders 39 and 40 could typically be four to ten line decoders Motorola type SN 7442.

Having now described our invention in connection with a particularly illustrated embodiment thereof, variations and modifications may now occur from time to time to those persons normally skilled in the art without departing from the essential scope or spirit of the invention, and accordingly it is intended to claim the same broadly as well as specifically as indicated by the appended claims.

What is claimed to be new and useful is:

1. Game apparatus comprising in combination, a. a plurality of movable counters, b. an action starting location and a target region to which said counters are moved from said starting location by a player controlled counter activating means, c. counter-contact-responsive signal generating means operatively coupled to said target region, d. a plurality of discrete counter guide means extending from different ones of a plurality of spaced apart locations of said target region to said signal generating means and to a common counter guide means, e. a counter collection region and a common counter guide means, said common counter guide means extending from said signal generating means to said collection region and being operative to guide said counters from said discrete counter guide means and from said signal generating means into said collection region, f. counter counting means operatively coupled to said common guide means effective to count each counter moving to said collection region, g. signal processing means operatively coupled to said signal generating means effective responsive to receipt of signals from the latter to generate signals for activating indicators which designate the game scoring, and h. a plurality of game scoring indicators operatively coupled to said signal processing means, said counter-contact-responsive signal generating means comprising a plurality of electric pulse generating means secured adjacent to said counter guide means so that said counters actuate selected ones of said electric pulse generating means in accordance with which of said discrete counter guide means guides said counter from said target area, and said signal processing means generates signals which increment the game scoring with positive or negative increments in accordance with which of said discrete counter guide means guides said counter from said target area.

2. Game apparatus as described in claim 1 further including played counter detecting means coupled to said signal processing means effective to prevent said signal processing means from altering the game score after a predetermined number of counters have been played.

3. Game apparatus as described in claim 1 wherein said signal processing means includes means operative to prevent a negative increment from reducing the game score below zero.

4. Game apparatus as described in claim 1 wherein said plurality of electric pulse generating means which generate positive scoring increments each generate an increment of equal scoring weight, are connected in electrical parallel circuit and are physically positioned sequentially along said common counter guide means.

5. Game apparatus as described in claim 1 wherein said plurality of electric pulse generating means which generate positive scoring increments each generate an increment of equal scoring weight, are connected in electrical parallel circuit and are physically positioned sequentially along said common counter guide means, and wherein said electric pulse generating means which generates negative scoring increments is physically positioned along at least one of said discrete counter guide means and said discrete guide means connects to said common counter guide means at a point effective to prevent a counter traversing said discrete guide means from actuating any of said electric pulse generating means which generate positive scoring increments.

6. Game apparatus as described in claim 5 further including played counter detecting means coupled to said signal processing means effective to prevent said signal processing means from altering the game score after a predetermined number of counters have been played.

7. Game apparatus as described in claim 6 wherein said played-counter detecting means prevents said signal processing means from altering the game score by rendering the latter insensitive to signals from said counter-contact-responsive signal generating means.

8. Game apparatus as described in claim 1 further including audible signal means operatively coupled to said signal processing means, said audible signal means generating a first type of sound whenever a positive scoring increment is generated by said signal processing means and generating a second type of sound audibly different from said first type of sound whenever a negative scoring increment is generated by said signal processing means.

9. A golf game apparatus comprising in combination, a. a plurality of balls, b. a golf tee and a target region to which said balls are driven from said tee by a club, c. ball-contact-responsive signal generating means operatively coupled to said target region, d. a plurality of discrete ball guide tracks extending from beneath different ones of a plurality of ball receiving scoring holes at spaced apart locations of said target region to said signal generating means and extending from a non-scoring ball receiver to a common ball guide track, e. a played ball collection region and a common ball guide track, said common ball guide track extending from said signal generating means to said played ball collection region and being operative to guide said balls from said discrete ball guide tracks and from said signal generating means into said played ball collection region, f. ball counting means operatively coupled to said common ball guide track effective to count each ball moving to said played ball collection region, g. signal processing means operatively coupled to said signal generating means effective responsive to receipt of signals from the latter to generate signals for activating indicators which designate the game scoring, and h. a plurality of game scoring indicators operatively coupled to said signal processing means, said ball-contact-responsive signal generating means comprising a plurality of electric pulse generating means secured adjacent to said ball guide means so that said played balls actuate selected ones of said electric pulse generating means in accordance with which of said discrete ball guide means guides said ball from said target area, and wherein said signal processing means generates signals which increment the game scoring with positive or negative increments in accordance with which of said discrete ball guide means guides said ball from said target area.

10. Game apparatus as described in claim 9 wherein said signal processing means includes means operative to prevent a negative increment from reducing the game score below zero.

11. Game apparatus as described in claim 9 wherein said plurality of electric pulse generating means which generate positive scoring increments each generate an increment of equal scoring weight, are connected in electrical parallel circuit and are physically positioned sequentially along said common ball guide means.

12. Game apparatus as described in claim 9 wherein said plurality of electric pulse generating means which generate positive scoring increments each generate an increment of equal scoring weight, are connected in electrical parallel circuit and are physically positioned sequentially along said common ball guide means, and wherein said electric pulse generating means which generates negative scoring increments is physically positioned along at least one of said discrete ball guide means and said discrete ball guide means connects to said common ball guide means at a point effective to prevent a ball traversing said discrete ball guide means from actuating any of said electric pulse generating means which generate positive scoring increments.

13. Game apparatus as described in claim 12 further including played counter detecting means coupled to said signal processing means effective to prevent said signal processing means from altering the game score after a predetermined number of balls have been played.

* * * * *